US005475350A

United States Patent [19]

Yamada et al.

[11] Patent Number: 5,475,350

[45] Date of Patent: Dec. 12, 1995

[54] FREQUENCY TUNABLE RESONATOR INCLUDING A VARACTOR

[75] Inventors: Toru Yamada, Katano; Toshio Ishizaki, Kobe; Yoshihiro Nakagawa, Osaka; Makoto Sakakura, Uji; Koji Hashimoto, Kobe; Toshiaki Nakamura, Nara, all of Japan

[73] Assignee: Matsushita Electric Industrial Co., Ltd., Kadoma, Japan

[21] Appl. No.: 127,500

[22] Filed: Sep. 28, 1993

[30] Foreign Application Priority Data

Sep. 29, 1992 [JP] Japan ..... 4-259545
Jun. 2, 1993 [JP] Japan ..... 5-131789

[51] Int. Cl.[6] ..... H01P 7/04; H01P 7/08; H01P 7/10

[52] U.S. Cl. ..... 333/223; 333/235

[58] Field of Search ..... 333/202, 204, 333/205, 219, 206, 207, 222, 223, 235; 331/96, 107 SL

[56] References Cited

U.S. PATENT DOCUMENTS

| | | | |
|---|---|---|---|
| 4,721,932 | 1/1988 | West | 333/207 |
| 4,926,142 | 5/1990 | Mettoudi | 331/99 |
| 4,983,938 | 1/1991 | Sasaki et al. | 333/223 X |
| 5,097,237 | 3/1992 | Komazaki et al. | 333/204 |
| 5,227,739 | 7/1993 | Mandai et al. | 331/107 SL X |

FOREIGN PATENT DOCUMENTS

| | | | |
|---|---|---|---|
| 069431 | 1/1983 | European Pat. Off. . | |
| 444948 | 9/1991 | European Pat. Off. . | |
| 63-90901 | 4/1988 | Japan . | |
| 1190008 | 7/1989 | Japan . | |
| 334608 | 2/1991 | Japan . | |
| 0192904 | 7/1992 | Japan | 331/96 |
| 0213204 | 8/1992 | Japan | 331/96 |
| 4358408 | 12/1992 | Japan . | |
| 0136612 | 6/1993 | Japan | 333/219 |
| 0235637 | 9/1993 | Japan | 331/96 |

*Primary Examiner*—Benny Lee
*Assistant Examiner*—Justin P. Bettendorf
*Attorney, Agent, or Firm*—Cushman, Darby & Cushman

[57] ABSTRACT

A coupled capacitor substrate having thereon a plane capacitor which is integrally bonded on a dielectric resonator and a varactor which is mounted on the coupled capacitor substrate so as to couple the dielectric resonator via the plane capacitor.

28 Claims, 11 Drawing Sheets

FREQUENCY TUNABLE RESONATOR INCLUDING A VARACTOR

BACKGROUND OF THE INVENTION

1. Field of the Invention

This invention relates to a frequency tunable resonator including a varactor (variable capacitance diode) which is widely used in an oscillator of frequencies from VHF to EHF bands.

2. Description of the Related Art

Recently, a resonance circuit combining a dielectric resonator and a varactor has been widely used in oscillators for high frequency wireless apparatuses.

A frequency tunable resonator including a varactor is configured by coupling a dielectric resonator and the varactor via a chip capacitor forming a resonance circuit on a circuit substrate.

FIG. 8 shows a configuration of a typical example of a conventional frequency tunable resonator including a varactor. As shown in FIG. 8, the conventional resonator comprises a dielectric resonator 81, a varactor 82, a printed substrate 83 and chip capacitors 84, 85 and 86. The dielectric resonator 81 is electrically connected to the varactor 82 via the chip capacitor 84. The chip capacitor 85 is a coupling capacitor for coupling an oscillation circuit, which is provided in an external oscillator (not shown), and the frequency tunable resonator including the varactor. The chip capacitor 86 is connected in parallel with the dielectric resonator 81, thereby lowering a resonance frequency. The conventional resonator further comprises a grounded electrode 87, a voltage control terminal 88 and a connection terminal 89 for the oscillation circuit.

Next, the operation of the conventional frequency tunable resonator including the varactor 82 will be explained with reference to FIG. 8. The dielectric resonator 81 is formed by short-circuiting at the end of a coaxial line so as to form quarter-wavelength resonator, and gives an infinite impedance at a resonance frequency. The varactor 82 varies its own capacitance depending upon a D.C. applied voltage, and thus can vary an oscillation frequency of the external oscillator by using this capacitance variation. A variation range of an oscillation frequency, which responds to a variation of D.C. applied voltage, can be varied by changing a capacitance of the chip capacitor 84 which connects the dielectric resonator 81 and the varactor 82. The smaller the capacitance is set, the narrower a variation range of a frequency becomes. On the contrary, the larger the capacitance is set, the wider the variation range of the frequency becomes.

The external oscillator oscillates at a frequency near the resonance frequency of the dielectric resonator 81 on the condition that an impedance of the resonance circuit using capacitances of the varactor 82 and the chip capacitor 84 meets an impedance requirement of the oscillation. Because the oscillation frequency generally shifts from the resonance frequency of the dielectric resonator 81 to a slightly lower frequency, the oscillation frequency is adjusted by cutting the length of the dielectric resonator 81 after mounting the dielectric resonator 81 and the chip capacitor 84 on the printed substrate 83.

However, the above-mentioned conventional frequency tunable resonator including the varactor 82 had some problems that miniaturization of them is difficult and that characteristic adjustment is possible only after mounting both parts on the printed substrate 83, because the dielectric resonator 81 and the varactor 82 are connected via a circuit formed on the printed substrate 83.

OBJECT AND SUMMARY OF THE INVENTION

In order to solve the above-mentioned problems, the invention is to provide a frequency tunable resonator including a varactor, which has a miniature size and does not require the characteristic adjustment after mounting parts on a printed substrate.

A frequency tunable resonator including a varactor in accordance with the present invention comprises:

a dielectric resonator;

a coupled capacitor substrate having thereon plane capacitors and being fixed on the dielectric resonator into an unitary configuration, and a varactor mounted on the coupled capacitor substrate, in a manner that the dielectric resonator is coupled with the varactor via the plane capacitors.

According to the present invention having the above-mentioned construction, a dielectric resonator and a varactor are connected via a plane capacitor using the above configuration, and therefore, realizes an integration of the dielectric resonator, capacitors and the varactor can be realized, and a frequency tunable resonator which is formed in a miniature size can be obtained. The characteristics adjustment is not required after mounting parts or components on a printed substrate.

While the novel features of the invention are set forth particularly in the appended claims, the invention, both as to organization and content, will be better understood and appreciated, along with other objects and features thereof, from the following detailed description taken in conjunction with the drawings.

BRIEF DESCRIPTION OF THE DRAWINGS

FIG. 1(*b*) is a plan view showing electrodes of a coupled capacitor substrate of the frequency tunable resonator of FIG. 1(*a*);

FIG. 1(*c*) is a side view of the coupled capacitor substrate of FIG. 1(*b*);

FIG. 1(*d*) is a rear view of the coupled capacitor substrate of FIG. 1(*b*);

FIG. 3(*b*) is a side view of the coupled capacitor substrate of FIG. 3(*a*);

FIG. 3(*c*) is a rear view of the coupled capacitor substrate of FIG. 3(*a*);

FIG. 5(*b*) is a plan view showing a coupled capacitor substrate of the frequency tunable resonator of FIG. 5(*a*);

FIG. 5(*c*) is a side view of the coupled capacitor substrate of FIG. 5(*b*);

FIG. 5(*d*) is a rear view of the coupled capacitor substrate of FIG. 5(*b*);

FIG. 6(*b*) is a plan view showing a coupled capacitor substrate of the frequency tunable resonator of FIG. 6(*a*);

FIG. 6(*c*) is a rear view showing the coupled capacitor substrate of FIG. 6(*b*);

FIG. 6(*d*) is a plan view showing a printed substrate for connecting external circuit;

FIG. 6(*e*) is a rear view of the printed substrate of FIG. 6(*d*);

FIG. 7(*b*) is a perspective view showing a rear face of the resonator of FIG. 6(*a*) for showing a second adjusting method;

It will be recognized that some or all of the Figures are schematic representations for purposes of illustration and do not necessarily depict the actual relative sizes or locations of the elements shown.

DESCRIPTION OF THE PREFERRED EMBODIMENTS

In the following paragraphs, a frequency tunable resonator including a varactor of the present invention will be explained in detail on the concerning the preferred embodiments shown in the attached drawings.

<<First Embodiment>>

Figure 1A:
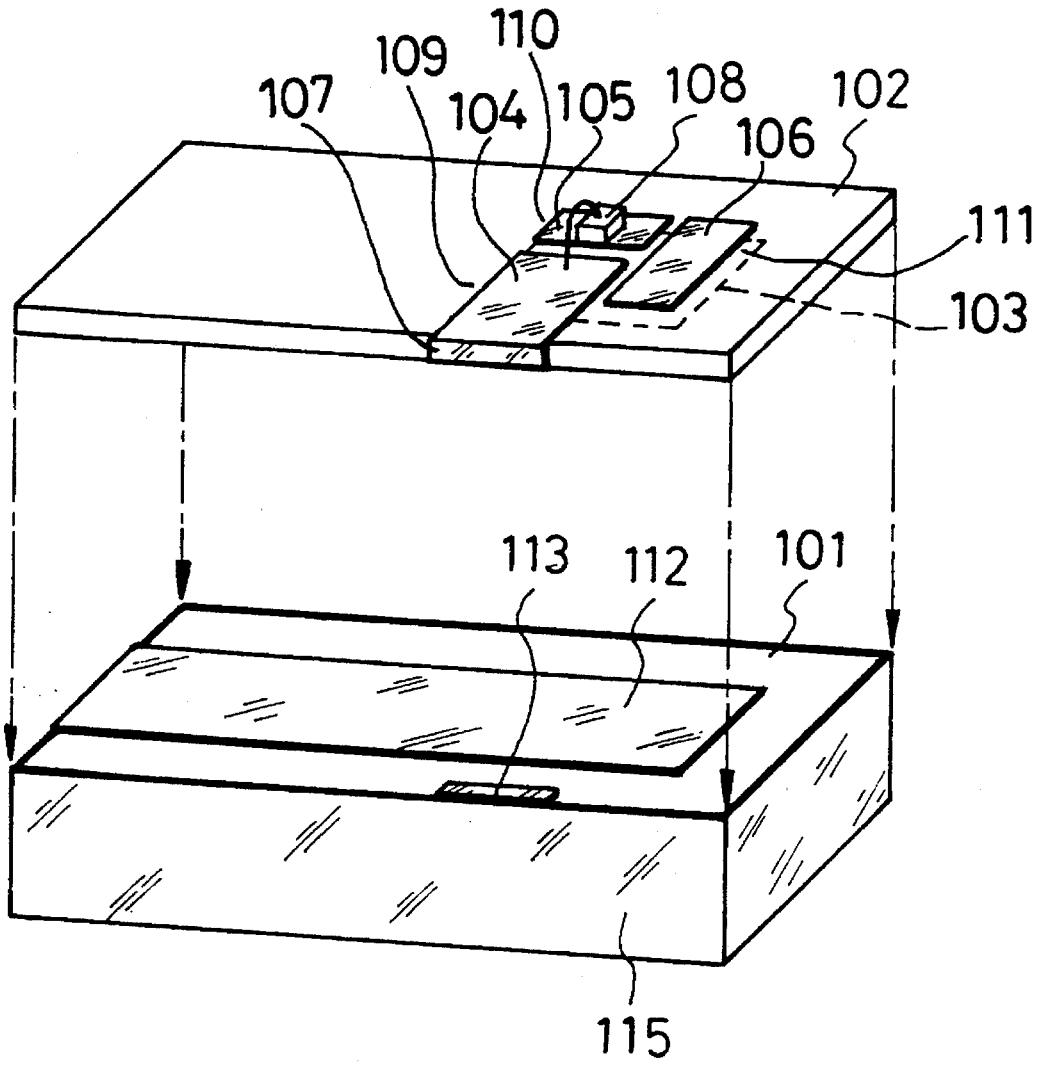
FIG. 1(*a*) is an exploded perspective view showing a frequency tunable resonator including a varactor of a first embodiment of the present invention.
Figure 1:
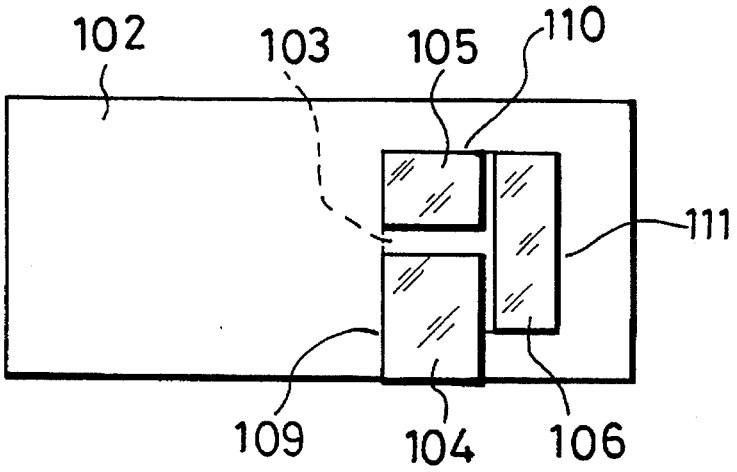
Figure 1:
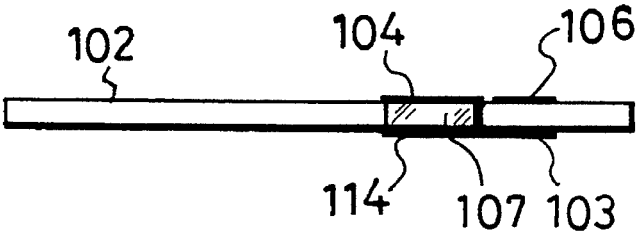
Figure 1:
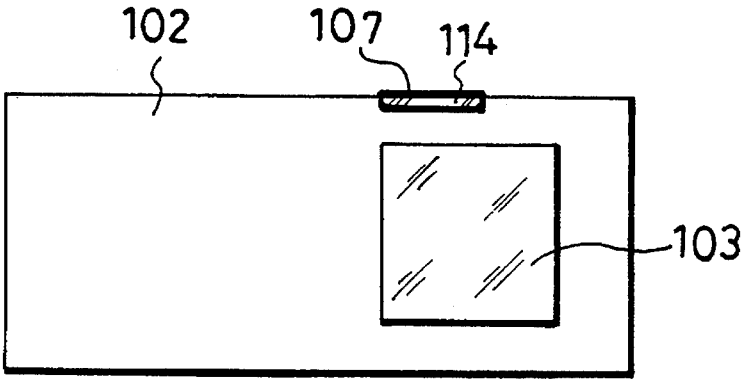

FIG. 1(*a*) is an exploded perspective view showing a frequency tunable resonator including a varactor of the first embodiment of the present invention, FIG. 1(*b*), FIG. 1(*c*) and FIG. 1(*d*) are respectively a plan view, a side view and a rear view showing electrodes of a coupled capacitor substrate of a frequency tunable resonator including a varactor shown in FIG. 1(*a*).

In FIG. 1(*a*), the coupled capacitor substrate 102 is mounted on a planar type dielectric resonator 101, and electrodes 103, 104, 105 and 106 are provided on the coupled capacitor substrate 102. Furthermore, a side electrode 107 is provided on a side face of the coupled capacitor substrate 102, and a varactor 108 is fixed on the electrode 105. The planar type dielectric resonator 101 is made by plating and planning a metal, such as Cu (thickness: 6~8 μm) or Ag (thickness: 10 μm), on a ceramic material block, such as barium titanate block.

A plane capacitor 109 is constructed by the electrodes 103 and 104, a plane capacitor 110 is constructed by the electrodes 103 and 105, and a plane capacitor 111 is constructed by the electrodes 103 and 106. The electrode 103 is connected to a strip line resonator electrode 112 of the planar type dielectric resonator 101, and the terminals of the varactor 108 are connected to the electrodes 104 and 105, respectively. In the first embodiment, an anode terminal of the varactor 108 is connected to the electrode 104, and a cathode terminal is connected to the electrode 105. The electrode 104 is connected via the side electrode 107 and a rear electrode 114 provided on the coupled capacitor substrate 102 to an electrode 113 of the planar type dielectric resonator so as to be grounded. The electrode 106 is connected to the oscillation circuit of the external oscillator (not shown). A reference numeral 115 indicates a grounded electrode.

Figure 2:
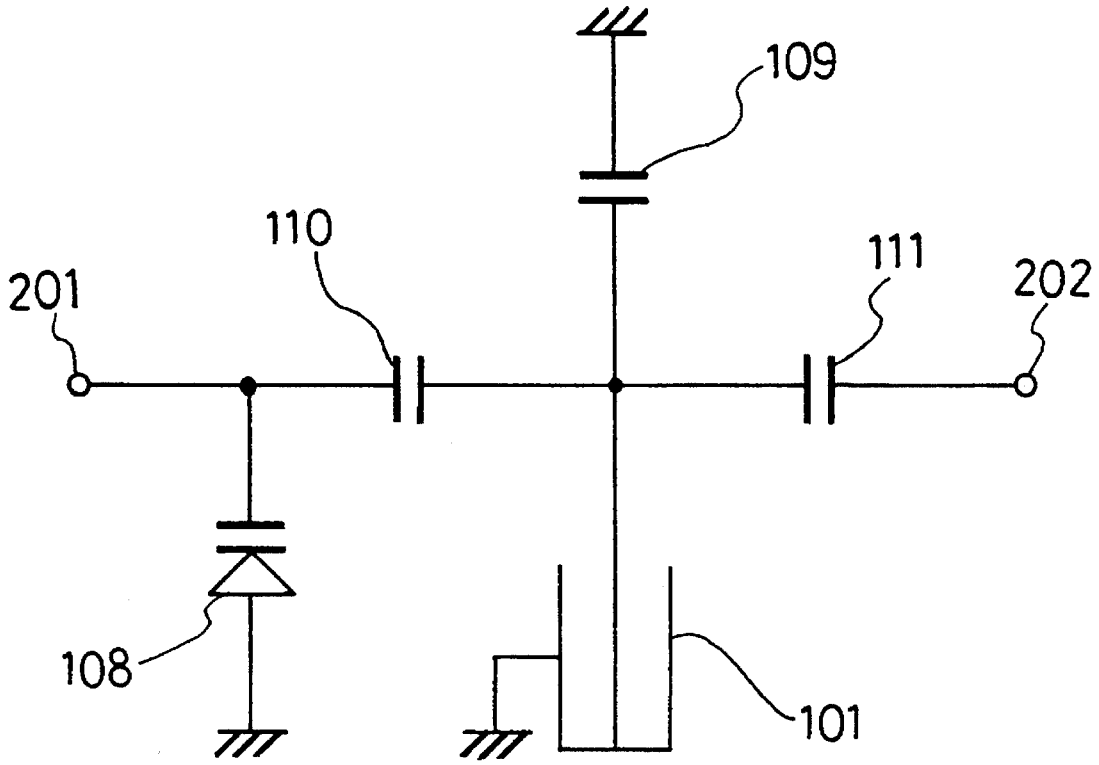
FIG. 2 is an equivalent circuit diagram of the frequency tunable resonator of the first embodiment of the present invention.

Next, the operation of the above-mentioned frequency tunable resonator including the varactor 108 will be explained further referring to FIG. 2. FIG. 2 shows an equivalent circuit diagram to the above-mentioned frequency tunable resonator including the varactor 108 of the first embodiment, and corresponding parts to the parts of FIG. 1 are designated by the same reference numerals. In FIG. 2, reference numeral 201 denotes a voltage control terminal, and reference numeral 202 indicates an oscillation circuit connection terminal.

The planar type dielectric resonator 101 is formed by short-circuiting at the end of a strip line resonator electrode 112 so as to have a length of a quarter-wavelength and has an infinite impedance at a resonance frequency. The varactor 108 varies its capacitance depending upon a D.C. applied voltage and can control an oscillation frequency of the oscillator by utilizing this capacitance variation. The plane capacitor 110 couples the varactor 108 with the planar type dielectric resonator 101, and a range of variation of oscillation frequencies which corresponds to variation of D.C. voltages applied to the varactor 108 can be varied by changing the capacitance of the plane capacitor 110. The plane capacitor 109 is electrically connected to an open end portion of the strip line resonator electrode 112 of the planar type dielectric resonator 101 and a grounded conductor 115, and operates to lower the resonance frequency. The plane capacitor 111 performs capacitive coupling between the planar type dielectric resonator 101 and the external oscillation circuit. That is, the plane capacitors 109, 110, and 111 perform the same function as that of the chip capacitors 86, 84 and 85 of the aforementioned conventional frequency tunable resonator shown in FIG. 8. The electrode 105 of the plane capacitor 110 serves as a voltage control terminal electrode, and the electrode 106 of the plane capacitor 111 serves as a connection terminal electrode for connecting the oscillation circuit.

Figure 8:
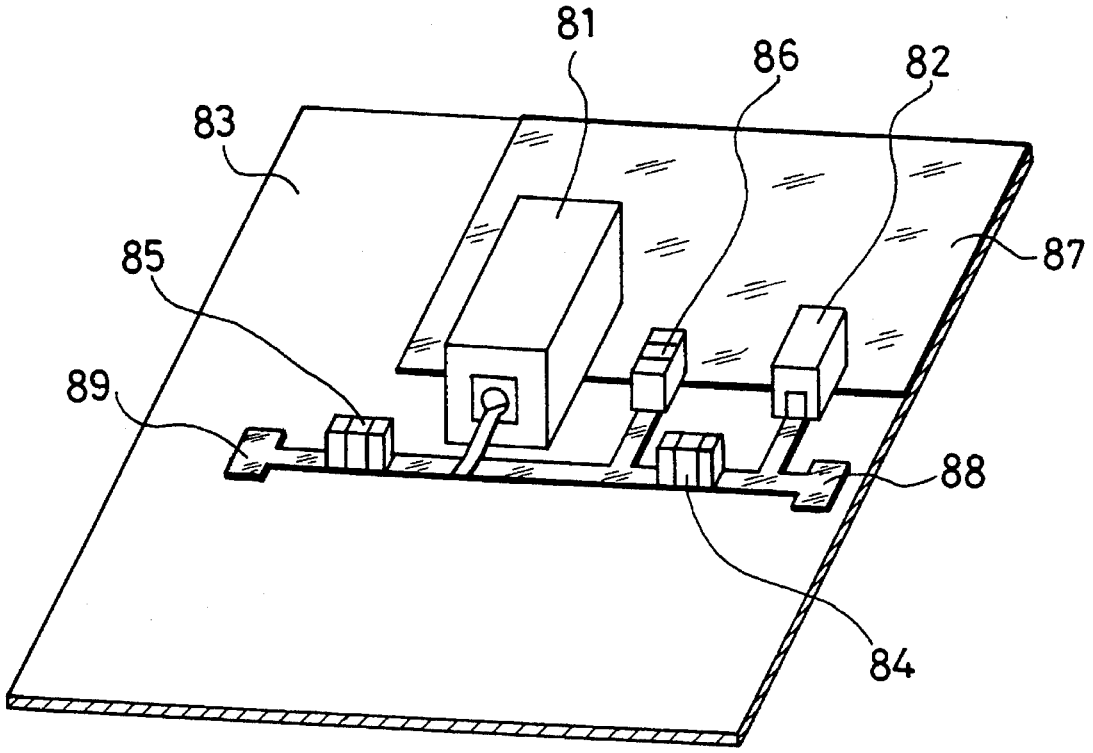
FIG.8 (Prior Art)
FIG. 8 is the perspective view showing a conventional frequency tunable resonator including the varactor.

In the above-mentioned configuration of the first embodiment, the plane capacitors 109, 110, and 111 are formed on the coupled capacitor substrate 102, and thus the frequency tunable resonator of the first embodiment of the invention can be miniaturized as compared with a conventional resonator using the chip capacitors. The rear electrode 103 of the plane capacitors 109, 110, and 111 are directly connected to the electrode 112 formed on the planar type dielectric resonator 101 by mechanical contacts, and the plane capacitors 109 and 110 are connected to the varactor 108 directly. Thus the configuration of the first embodiment does not require a printed circuit on substrate as shown in FIG. 8. And an adverse effect due to an inductance in the wiring patterns of the printed substrate can be eliminated by the configuration of the embodiment.

Furthermore, in the first embodiment, the planar type dielectric resonator 101, plane capacitors 109, 110, 111 and the varactor 108 are integrated into one unit, and hence the characteristics of the frequency tunable resonator including the varactor 108 can be measured by easy handling. Thus, dispersion or scattering of the oscillator's characteristic can be minimized by trimming the frequency tunable resonator including the varactor 108 before mounting it on a substrate having active elements, etc., in the oscillator (not shown). As a result, the productivity is improved. Frequency adjusting of the frequency tunable resonator including the varactor as a whole can be effected not only by trimming the strip line resonator electrode 112 of the dielectric resonator but also by varying the size of the electrodes 104, 105 and 106. Therefore a frequency adjusting range becomes wide and degradation of resonance Q caused by cutting the dielectric resonator can be reduced. In the aforementioned conventional device, it was difficult to control a range of variation of oscillation frequencies which corresponds to variation of D.C. voltages applied to the varactor 108. But, in the first embodiment, it can be easily performed by varying the size of the electrode 105.

Figure 3A:
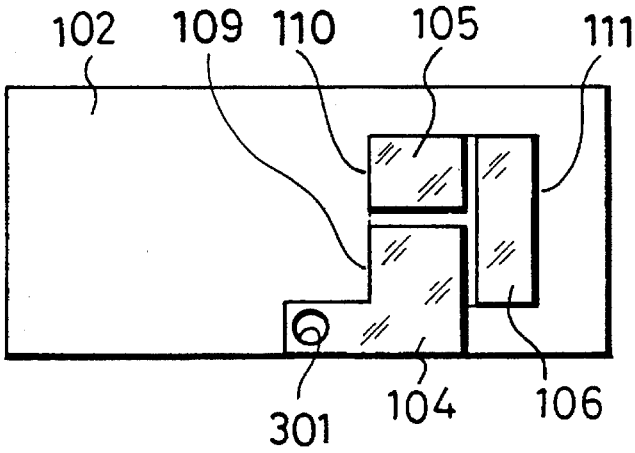
FIG. 3(*a*) is a plan view showing a coupled capacitor substrate having another structure of the first embodiment of the present invention.
Figure 3B:
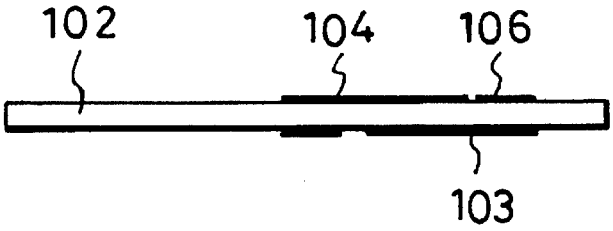
Figure 3C:
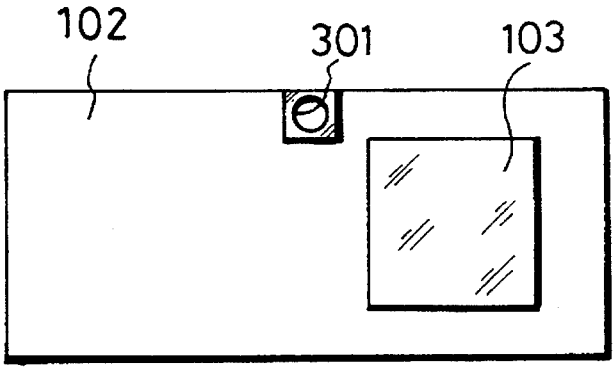

In the first embodiment, the electrode 104 is electrically connected to the rear electrode 114 of the coupled capacitor substrate 102 via the side electrode 107. But instead, it may be connected via hole 301 provided on the coupled capacitor substrate 102 as shown in FIGS. 3(*a*)–3(*c*).

<<Second Embodiment>>

A second embodiment of the present invention will be explained with reference to the drawings.

Figure 4:
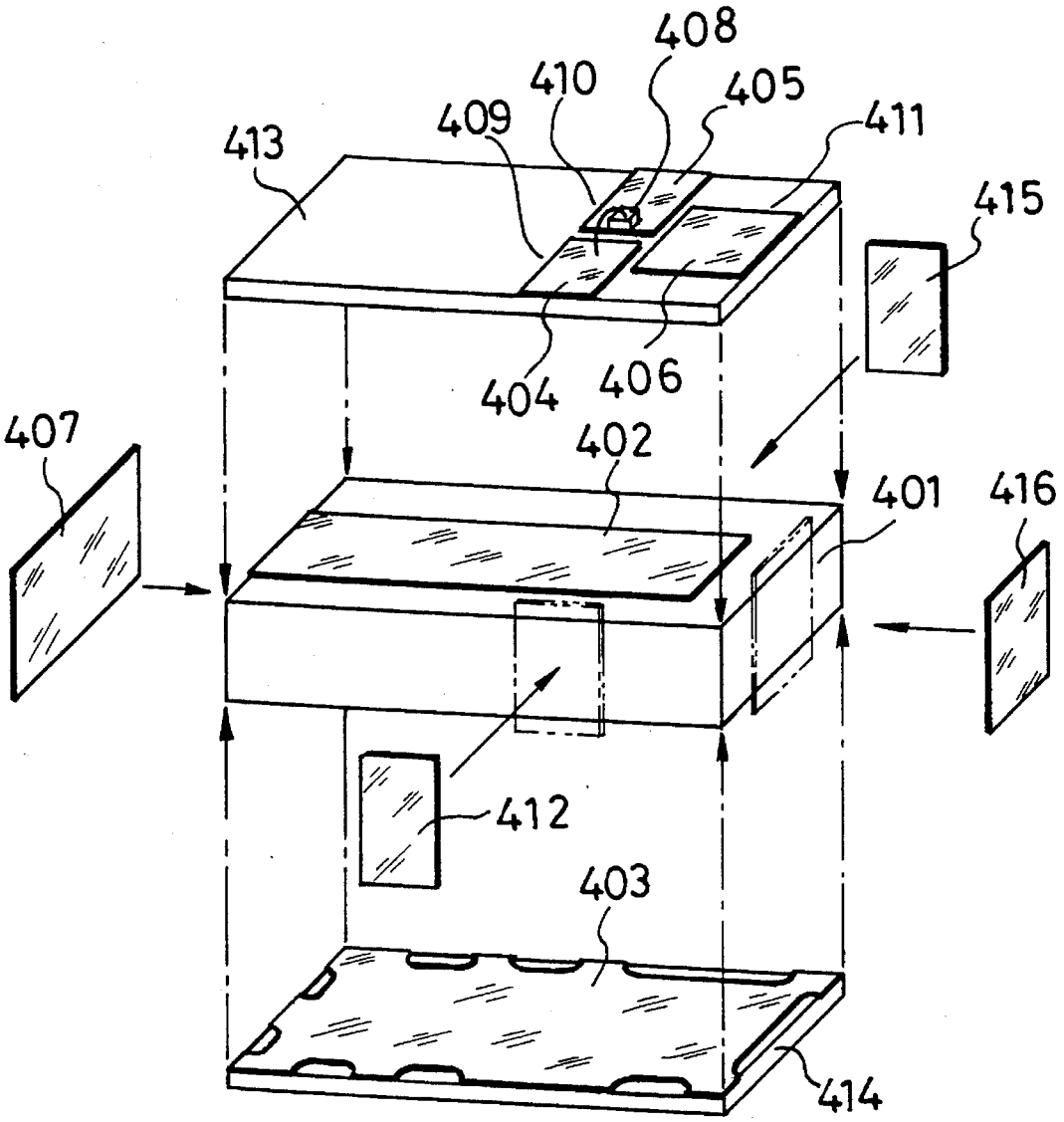
FIG. 4 is an exploded perspective view showing a frequency tunable resonator including a varactor of a second embodiment of the present invention.

FIG. 4 is an exploded perspective view showing a frequency tunable resonator including a varactor of the second embodiment of the present invention. In FIG. 4, the frequency tunable resonator comprises laminate type dielectric resonator block 401, a resonator electrode 402, a shield electrode 403, capacitor electrodes 404, 405 and 406 forming capacitors, a side grounded electrode 407 for connecting the short-circuit side of the resonator electrode 402 to the shield electrode 403 to be grounded, and a varactor 408. The resonator also includes a capacitor 409 constructed by the resonator electrode 402 and the capacitor electrode 404, a capacitor 410 constructed by the resonator electrode 402 and the capacitor electrode 405, and a capacitor 411 constructed by the resonator electrode 402 and the capacitor electrode 406. The terminals of the varactor 408 are connected to the capacitor electrode 404 and the capacitor electrode 405, respectively. In this second embodiment, an anode terminal of the varactor 408 is connected to the capacitor electrode 404, and:a cathode terminal is connected to the capacitor electrode 405. The capacitor electrode 405 is connected to a voltage control terminal 415 and supplied with a control voltage from an external unit. The capacitor electrode 404 is connected via a side-face-grounded electrode 412 to the shield electrode 403 to be grounded; and the capacitor electrode 406 is connected via an oscillation circuit connection electrode 416 to an external oscillation circuit (not shown).

The difference of the second embodiment of FIG. 4 from the first embodiment of FIG. 1 resides in that the whole of the frequency tunable resonator is formed by a laminate structure. The other portions are almost the same.

Next, the operation of the above-mentioned frequency tunable resonator of the second embodiment will be explained with reference to FIG. 4. An equivalent circuit of the frequency tunable resonator including the varactor 408 of the second embodiment is the same as that of FIG. 2, and thus the principle of operation of the circuit is almost the same as the first embodiment. The resonator electrode 402 is short-circuited at the end of strip line of substantially a quarter-wavelength, and the laminated dielectric resonator obtains the maximum impedance at a resonance frequency. The capacitor 410 couples the varactor 408 and the resonator electrode 402. A range of variation of oscillation frequencies which corresponds to variation of D.C. voltages applied to the varactor 408 can be varied by changing the capacitance of the capacitor 410. The capacitor 409 functions to lower a resonance frequency of the frequency tunable resonator of the second embodiment. The capacitor 411 capacitively couples the frequency tunable resonator and the oscillation circuit of an oscillator (not shown).

Because the frequency tunable resonator of the second embodiment is constructed by the laminated structure, a thickness of a dielectric sheet 413 between the resonator electrode 402 and the capacitor electrode 404, 405 or 406 can be made as thin as 20 μm. Therefore, the capacitor 409, which lowers a resonance frequency of the frequency tunable resonator, can be made to have a large capacitance, thereby reducing the frequency tunable resonator. Furthermore, because the frequency tunable resonator and the capacitors are integrally formed, the number of parts can be reduced.

As mentioned above, in the second embodiment, the whole of the frequency tunable resonator can be miniaturized and thinned by employing the laminated structure. The productivity can be improved by reducing the number of parts and assembling hours. And further, the frequency tunable resonator of the second embodiment is suited for mass-production, because the frequency tunable resonator is constructed by the abovementioned laminated structure.

The frequency tunable resonator of the second embodiment may be structured so that another dielectric sheet is overlapped on the dielectric sheet 413 having electrodes as inner electrodes of the capacitors, and the capacitor electrodes 404 and 405 are extended to an upper face via the side-face-grounded electrode 412 of the lamination type dielectric resonator block 401 and the voltage control terminal electrode 415, and then the varactor 408 is mounted on these extended electrodes.

<<Third Embodiment>>

Figure 5:
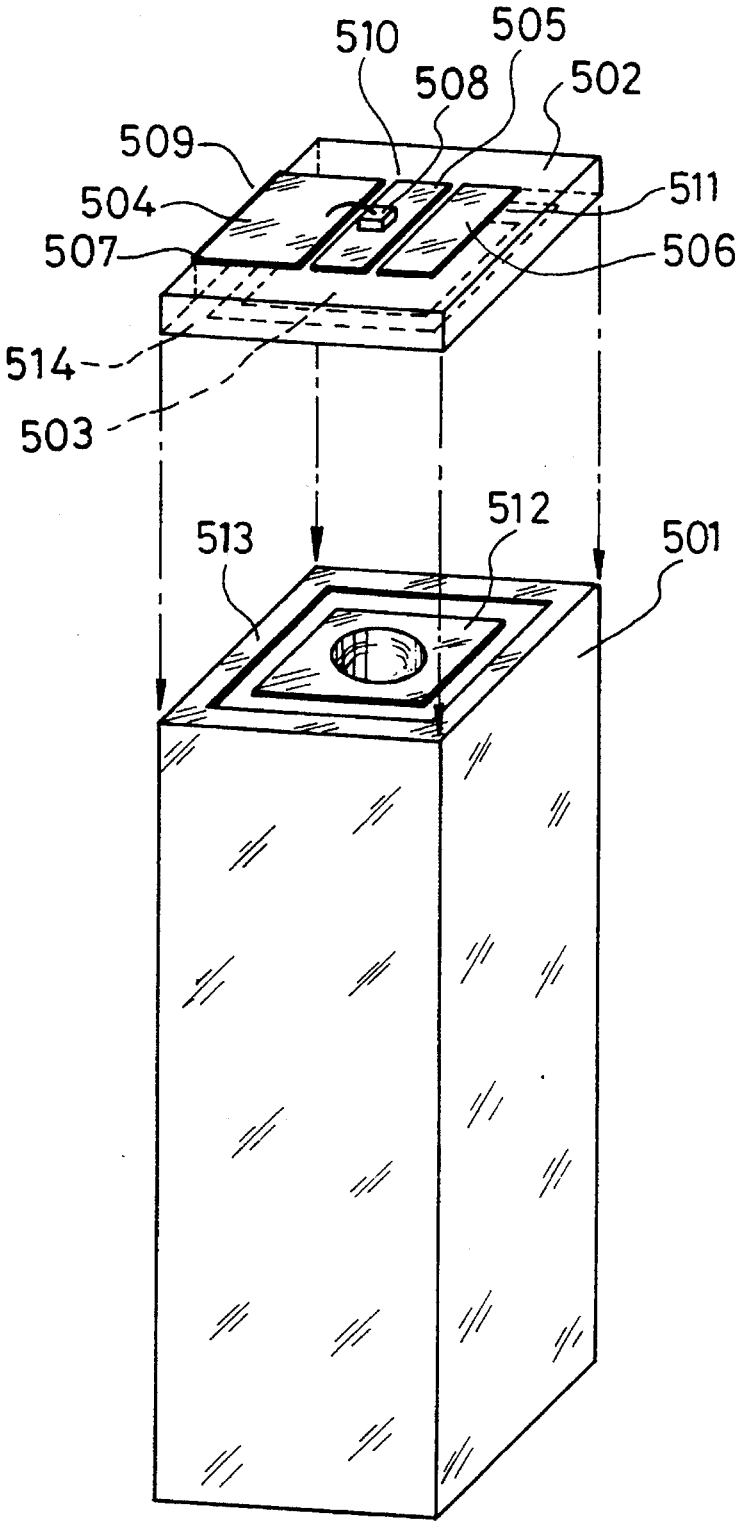
FIG. 5(*a*) is an exploded perspective view showing a frequency tunable resonator including a varactor of a third embodiment of the present invention.
Figure 5C:
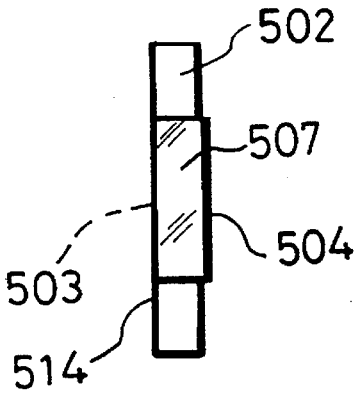
Figure 5B:
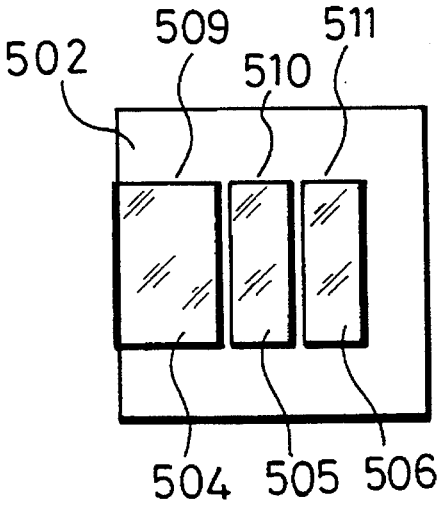
Figure 5D:
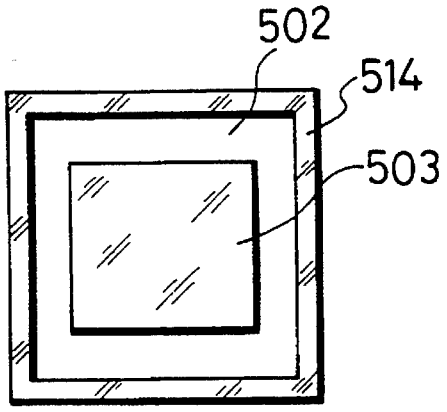

A third embodiment of the present invention will be explained with reference to FIGS. 5(*a*), 5(*b*), 5(*c*) and 5(*d*). FIG. 5(*a*) is an exploded perspective view showing a frequency tunable resonator including a varactor of the third embodiment of the present invention, FIG. 5(*b*) is a plan view showing a coupled capacitor substrate 502. FIG. 5(*c*) is a side view of the coupled capacitor substrate 502 of FIG. 5(*b*). FIG. 5(*d*) is a bottom view of the coupled capacitor substrate 502 of FIG. 5(*b*).

As shown in FIG. 5(*a*), the frequency tunable resonator comprises a coaxial type dielectric resonator 501, a coupled capacitor substrate 502, electrodes 503, 504, 505 and 506 which are formed on the coupled capacitor substrate 502, a side electrode 507 which are formed on a side face of the coupled capacitor substrate 502 and a varactor 508. A plane capacitor 509 is constructed by the electrodes 503 and 504; a plane capacitor 510 is constructed by the electrodes 503 and 505; and a plane capacitor 511 is constructed by the electrodes 503 and 506. Electrode 503 is contacts an inner conductor connection electrode 512 which is formed on an open end face of the coaxial type dielectric resonator 501 as shown in FIG. 5(*a*). The terminals of the varactor 508 are connected to the electrodes 504 and 505, respectively. In this third embodiment, an anode terminal of the varactor 508 is connected to the electrode 504, and a cathode terminal is connected to the electrode 505. The electrode 504 is connected via the side electrode 507 and a rear electrode 514 formed on the coupled capacitor substrate 502 as shown in FIG. 5(*d*), to an outer conductor connection electrode 513 to be grounded, and the electrode 506 is connected to an oscillation (not shown).

A difference of the third embodiment of FIGS. 5(*a*), 5(*b*), 5(*c*) and 5(*d*) from the first embodiment of FIG. 1 resides in that the dielectric resonator is changed from the planar type dielectric resonator 101 to the coaxial type dielectric resonator 501. The other parts are almost the same as of FIG. 1.

Next, the operation of the above-mentioned frequency tunable resonator including the varactor of the third embodiment will be explained with reference to FIG. 5(*a*). The coaxial type dielectric resonator 501 is obtained by short-circuiting at the end of a coaxial line (transmission line) of substantially a quarter-wavelength, and has an infinite impedance at a resonance frequency. A resonator having a higher Q value than that of a planar type dielectric resonator can be obtained by using a coaxial dielectric resonator. The varactor 508 varies its own capacitance depending upon a D.C. applied voltage, and thus an oscillation frequency of an oscillator can be adjusted by utilizing this capacitance variation. The plane capacitor 510 couples the varactor 508 and coaxial type dielectric resonator 501, and thus a range of variation of oscillation frequencies which corresponds to variation of D.C. voltages applied to the varactor 508 can be varied by changing the capacitance of the plane capacitor 510. The plane capacitor 509 is connected to an open end of the inner conductor connection electrode 512 of the coaxial type dielectric resonator 501 and a grounded conductor 513 and operates to lower a resonance frequency. The plane capacitor 511 capacitively couples the coaxial type dielectric resonator 501 and the external oscillation circuit. The electrode 505 serves as a voltage control terminal electrode, and the electrode 506 also serves as an oscillation circuit connection terminal electrode.

As mentioned above, this third embodiment can realize a frequency tunable resonator including a varactor which has a high Q value by employing a coaxial type dielectric resonator as the resonator.

In the third embodiment, the electrode 504 is connected to the rear electrode 514 of the coupled capacitor substrate 502 via the side electrode 507; but alternatively it may be connected via a plated through hole.

<<Fourth Embodiment>>

A fourth embodiment of the present invention will be explained with reference to the drawings.

Figure 6:
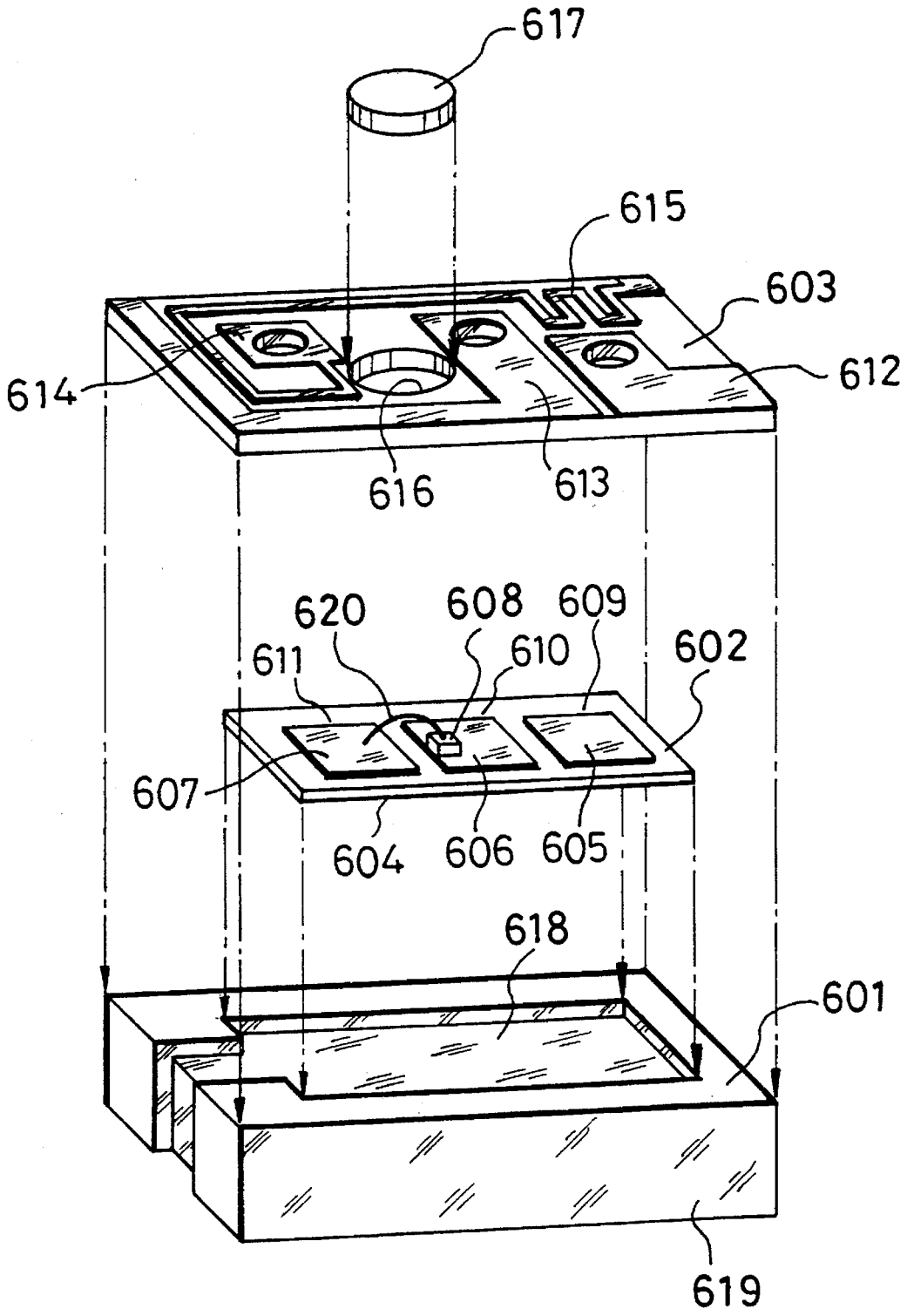
FIG. 6(*a*) is an exploded perspective view showing a frequency tunable resonator including a varactor of a fourth embodiment of the present invention.
Figure 6:
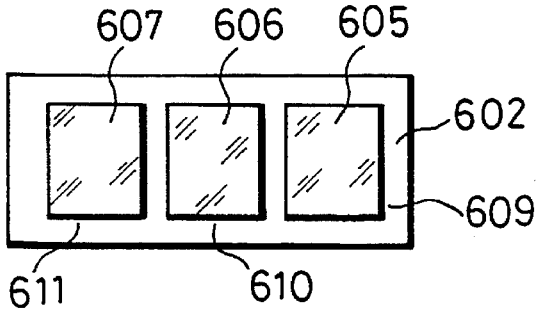
Figure 6:
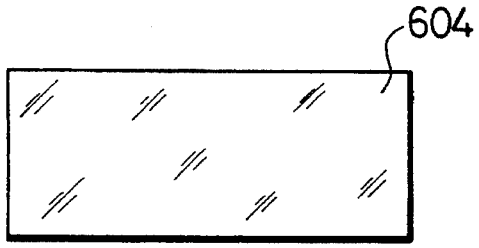
Figure 6:
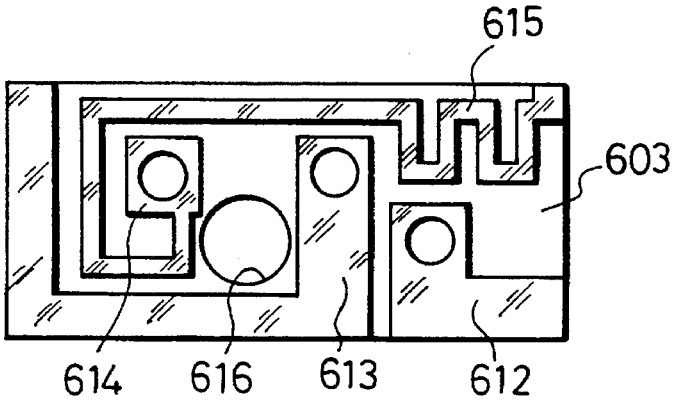
Figure 6:
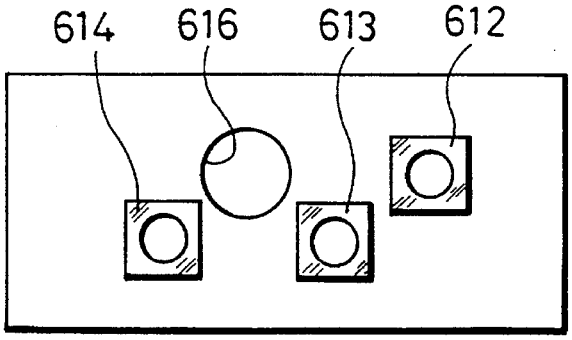

FIG. 6(*a*) is an exploded perspective view showing a frequency tunable resonator including a varactor of the fourth embodiment of the present invention. FIG. 6(*b*) is a plan view showing a coupled capacitor substrate 602, and FIG. 6(*c*) is a rear view showing the coupled capacitor substrate 602. FIG. 6(*d*) is a plan view showing a printed substrate 603. FIG. 6(*e*) is a rear view of the printed substrate 603.

As shown in FIG. 6(*a*), the frequency tunable resonator of this fourth embodiment comprises a planar type dielectric resonator 601, the coupled capacitor substrate 602, the printed substrate 603 for connecting of an external circuit, electrodes 604, 605, 606 and 607 which are formed on the coupled capacitor substrate 602, and a varactor 608. A plane capacitor 609 is constructed by the electrodes 604 and 605, a plane capacitor 610 is constructed by the electrodes 604 and 606, and a plane capacitor 611 is constructed by the electrodes 604 and 607. Each terminal electrode 612, 613 or 614 having a plated through hole is formed on the printed substrate 603 with an electrode pattern 615. A through hole 616 is provided in the printed substrate 603 and sealed with hermetic material 617. A reference numeral 618 denotes a strip line resonator electrode having a recess shape which is formed over a recess-bottom face and recess-side faces of the planar type dielectric resonator 601. The strip line resonator electrode 618 is short-circuit portion to a grounded electrode 619 on a lower face of the planar type dielectric resonator 601. The electrode 604 is contacted to the strip line resonator electrode 618, and the terminals of the varactor 608 are connected to the electrodes 606 and 607, respectively. In this forth embodiment, an anode terminal of the varactor 608 is connected to the electrode 606, and a cathode terminal is connected to the electrode 607. The electrode 605 is connected via a plated through hole to the oscillation circuit connection terminal electrode 612 on the printed substrate 603, and the electrode 606 is connected via the plated through hole to the terminal electrode 613 for grounding, and the electrode 607 is connected via the plated through hole to the voltage control terminal electrode 614. A reference numeral 620 denotes a connecting wire at the varactor 608.

A difference of the fourth embodiment of FIGS. 6(*a*), 6(*b*), 6(*c*), 6(*d*) and 6(*e*) from the first embodiment of FIG. 1 resides in that the electrode portion of the planar type dielectric resonator 601 is provided in the recess, in which the coupled capacitor substrate 602 is placed, and furthermore the printed substrate 603 for connecting to a circuit (not shown) is bonded together with the planar type dielectric resonator so as to be formed into an integration. The other parts are almost the same as of FIG. 1.

Next, the operation of the above-mentioned frequency tunable resonator including the varactor of the fourth embodiment will be explained with reference to FIG. 6(*a*). The planar type dielectric resonator 601 is obtained by short-circuiting at the end of a strip line of substantially a quarter-wavelength and realizes an infinite impedance at a resonance frequency. The plane capacitor 611 couples the varactor 608 and the planar type dielectric resonator 601. Thus, a range of variation of oscillation frequencies which corresponds to variation of D.C. voltages applied to the varactor 608 can be varied by changing the capacitance of the plane capacitor 611. The plane capacitor 610 is connected to an open end portion of the strip line resonator electrode 618 of the planar type dielectric resonator 601 and the grounded terminal electrode 613 of the printed substrate 603, and operates to lower a resonance frequency. The plane capacitor 609 capacitively couples the planar type dielectric resonator 601 and the external oscillation circuit.

In the above-mentioned structure of this fourth embodiment, the frequency tunable resonator including the varactor 608 is configured as a module of a unitary body having the terminal electrodes, and therefore this structure facilitates mounting of the resonator on another printed substrate.

In addition, since the electrodes of the plane capacitors and the terminal electrodes on the printed substrate 603 are contacted via the plated through holes formed in the printed substrate 603, these connections between the electrodes and terminal electrodes can be easily effected by inserting solder into the plated through holes of the printed substrate 603.

Furthermore, by forming the through hole 616 in a portion of the printed substrate 603 overlapping the varactor 608, the printed substrate 603 is prevented from contacting with the varactor 608 and the connecting wire 620. And connections between the varactor 608 and the electrodes on the coupled capacitor substrate 602 can be easily checked via the through hole 616. And furthermore, by sealing the through hole 616 with hermetic material 617 such as resin, imperfect contact between the varactor 608 and electrodes can be prevented and durability of the frequency tunable resonator as a module is improved. Besides, before sealing, the electrodes 606 and 607 of the plane capacitors can be contacted directly through the through hole 616, therefore a connection test between the electrodes 606 and 607 and the terminal electrode 613 and 614 can be performed easily. In addition, a resonance frequency or a range of variation of resonance frequencies can be adjusted by cutting the electrode of the plane capacitor. Furthermore, an electrode pattern as shown in FIG. 6(*a*) can be formed anywhere on the printed substrate 603, and therefore a device such as a high frequency choke coil circuit using a coil electrode pattern, which has been conventionally formed on an external circuit substrate, can be formed on a printed substrate as a module. Thus miniaturization of the device can be realized.

In addition, the resonator electrode 618 on the planar type dielectric resonator 601 is formed into the recess-shape strip line, and a line width is made wide on the open end portion and narrow on the short-circuit end portion. Therefore, positioning of the planar type dielectric resonator 601 and the coupled capacitor substrate 602 can be performed easily by dropping the coupled capacitor substrate 602 into the recess of the open end portion, and this construction improves the productivity. Furthermore, a decrease of electrode width on the short-circuit end portion of the resonator electrode 618 leads to an increase of an equivalent line length of the strip line, and hence miniaturization of the planer type dielectric resonator 601. Furthermore, the forming of the resonator electrode 618 both over the upper face and the side face of the planer type dielectric resonator 601 leads to further miniaturization of the dielectric resonator is realized.

Figure 7A:
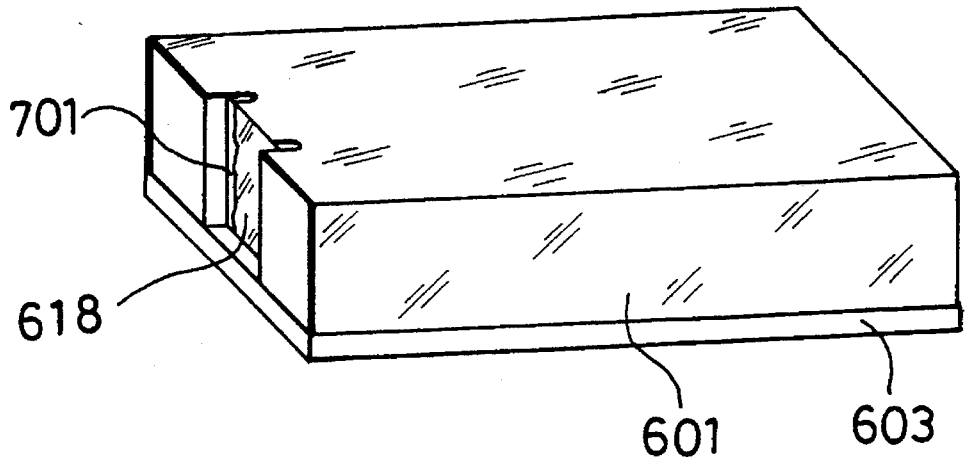
FIG. 7(*a*) is a perspective view showing a rear face of the frequency tunable resonator of FIG. 6(*a*) for showing a first adjusting method.
Figure 7B:
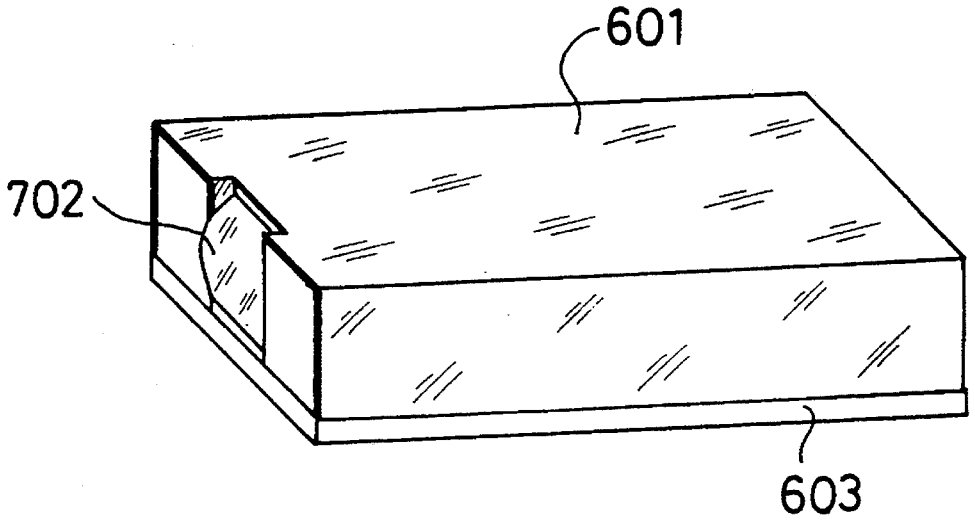

In addition, as shown in FIG. 7(*a*) which is a rear view of an adjusted frequency tunable resonator including a varactor after assembling, side electrode of the resonator electrode 618 is exposed outward, and therefore, by cutting this portion 701, an equivalent line length of the strip line can be increased so as to lower a resonance frequency, or as shown in FIG. 7(*b*), by heaping up some solder 702, the equivalent line length can be decreased so as to raise the resonance frequency. As a result, resonant frequency can be adjusted after assembling a module of the frequency tunable resonator including the varactor.

Apart from the above-mentioned embodiments, wherein a frequency tunable resonator including a varactor is applied to a high frequency oscillator, a modified embodiment may be such that a frequency tunable resonator including a varactor can be applied to a high frequency filter or the like besides a high frequency oscillator.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A frequency tunable resonator comprising:

a dielectric resonator;

a coupled capacitor substrate having a first surface and a second surface and being fixed on said dielectric resonator into an unitary configuration;

a first electrode provided on said first surface of said coupled capacitor substrate;

a second electrode provided on said second surface of said coupled capacitor substrate, said first electrode and said second electrode defining a plane capacitor; and a varactor mounted on said coupled capacitor substrate such that said dielectric resonator is coupled with said varactor via said plane capacitor.

2. A frequency tunable resonator including a varactor comprising:

a dielectric resonator;

a first substrate fixed on said dielectric resonator;

a pair of electrodes, wherein each electrode in said pair of electrodes is provided on a separate surface portion of said first substrate such that said pair of electrodes define a plane capacitor;

a second substrate providing an external circuit connection, wherein said first substrate, said dielectric resonator and said second substrate are fixed into a unitary configuration; and a terminal electrode disposed on said second substrate and electrically connected to said plane capacitor.

3. A frequency tunable resonator including a varactor in accordance with claim 2, wherein said dielectric resonator is a planar type dielectric resonator having a quarter-wavelength strip line electrode attached thereto, said planar type dielectric resonator having an open end portion connected to a first electrode in said pair of electrodes, said first electrode being disposed on a first surface of said first substrate, a second electrode in said pair of electrodes being disposed on a second surface of said first substrate opposing said first electrode and connected to said terminal electrode disposed on said second substrate, said frequency tunable resonator further comprising:

a third electrode disposed on said second surface of said first substrate opposing said first electrode and connected to said varactor, and a fourth electrode disposed on said second surface of said first substrate opposing said first electrode and connected to said varactor.

4. A frequency tunable resonator including a varactor in accordance with claim 3, wherein said second substrate includes a hole therethrough, wherein said hole includes plating therein for connecting said plane capacitor formed on said first substrate to said terminal electrode disposed said second substrate.

5. A frequency tunable resonator including a varactor in accordance with claim 3, wherein said second substrate includes a hole therethrough, wherein said hole has plated wall portions, and wherein said planar type dielectric resonator, said first substrate and said second substrate are bonded together, and said terminal electrode is mechanically and electrically connected to said plane capacitor via hole in said second substrate.

6. A frequency tunable resonator including a varactor in accordance with claim 3, wherein said varactor is mounted on said first substrate, and a through hole is defined in a portion of said second substrate which overlaps said varactor to prevent said varactor from contacting said second substrate, and wherein said through hole is sealed with a resin.

7. A frequency tunable resonator including a varactor in accordance with claim 3, wherein said second substrate has at least one hole defined therethrough in a portion which overlaps a part of an electrode pattern disposed on said first substrate and including said plane capacitors disposed on said first substrate, so as to enable said electrode pattern to be connected to an external terminal.

8. A frequency tunable resonator including a varactor in accordance with claim 3, wherein said second substrate includes a coil electrode formed thereon so as to provide a high frequency choke circuit.

9. A frequency tunable resonator including a varactor in accordance with claim 3, wherein said planar type dielectric resonator includes a recess defined therein said recess receiving said first substrate therein so that said first substrate is fitted in said planar type dielectric resonator.

10. A frequency tunable resonator including a varactor in accordance with claim 3, wherein said planar type dielectric resonator includes a recess defined therein, said recess has a first width at a first portion of said planar type dielectric resonator and a second width at a second portion of said planar type dielectric resonator, said second width being narrower than said first width and first width being great enough so as to receive said first substrate in said first portion of said planar type dielectric resonator.

11. A frequency tunable resonator including a varactor in accordance with claim 3, wherein said planar type dielectric resonator includes a first recess defined therein which covers a first portion of said planar type dielectric resonator on an upper surface thereof and a second recess defined therein which covers a second portion on a side surface of said planar type dielectric resonator adjacent said upper surface.

12. A frequency tunable resonator including a varactor according to claim 3, wherein said planar type dielectric resonator includes a first recess defined therein which covers a portion of an upper surface of said planar type dielectric resonator and a second recess defined therein which covers a portion a side surface of said planar type dielectric resonator adjacent said upper surface, and further comprising an electrode provided on said side surface of said planar type dielectric resonator, wherein a resonance frequency of said frequency tunable resonator is adjusted by cutting said electrode.

13. A frequency tunable resonator including a varactor in accordance with claim 3, wherein said planar type dielectric resonator includes a first recess defined therein which covers a portion of an upper surface of said planar type dielectric resonator and a second recess defined therein which covers a portion of a side surface of said planar type dielectric resonator adjacent said upper surface, and further comprising an electrode provided on said side surface of said planar type dielectric resonator, wherein a resonance frequency of said frequency tunable resonator is adjusted by heaping up solder on said electrode.

14. A frequency tunable resonator including a varactor comprising:

a planar type dielectric resonator configured of an end short-circuited quarter-wavelength strip line and having a first side;

a coupled capacitor substrate having a first surface and a second surface opposing said first surface, said coupled capacitor substrate being connected to said first side of said planar type dielectric resonator;

a first electrode disposed on said first surface of said coupled capacitor substrate;

a second electrode disposed on said second surface of said coupled capacitor substrate such that said first electrode and said second electrode define a plane capacitor; and a varactor having a first terminal and a second terminal, said second electrode being connected to said first terminal of said varactor thereby coupling said planar type dielectric resonator with said varactor via said plane capacitor.

15. A frequency tunable resonator including a varactor in accordance with claim 14, further comprising:

a grounded electrode disposed on said second surface of said coupled capacitor substrate;

a resonator grounded electrode disposed on a first portion of said planar type dielectric resonator; and a side electrode disposed on a side surface of said coupled capacitor substrate, said grounded electrode being connected to said resonator grounded electrode via said side electrode, and wherein said second terminal of said varactor terminal is connected to said grounded electrode.

16. A frequency tunable resonator including a varactor in accordance with claim 14, further comprising:

a grounded electrode disposed on said second surface of said coupled capacitor substrate; and a resonator grounded electrode disposed on first portion of said planar type dielectric resonator, said coupled capacitor substrate having a plated hole defined therein such that said grounded electrode is connected to said resonator grounded electrode via said plated hole, and wherein said second terminal of said varactor is connected to said grounded electrode.

17. A frequency tunable resonator including a varactor in accordance with claim 14, further comprising a third electrode disposed in a residual area of said second surface of said coupled capacitor substrate opposing said first electrode, said third electrode being used as an external connection terminal.

18. A frequency tunable resonator including a varactor in accordance with claim 14, further comprising a third electrode disposed in a part of a residual area of said second surface of said coupled capacitor substrate opposing said first electrode, said third electrode being used as an external connection terminal;

a fourth electrode disposed on said second surface of said coupled capacitor substrate opposing said first electrode and being connected to said second terminal of said varactor; and a side electrode disposed on a side surface of said coupled capacitor substrate for grounding said fourth electrode.

19. A frequency tunable resonator including a varactor in accordance with claim 14, further comprising a third electrode disposed in a part of a residual area of said second surface of said coupled capacitor substrate opposing said first electrode, said third electrodes being used as an external connection terminal;

a fourth electrode disposed on said second surface of said coupled capacitor substrate opposing said first electrode and being connected to said second terminal of said varactor, and wherein said coupled capacitor substrate includes a plated hole defined therein, said fourth electrode being grounded via said plated hole.

20. A frequency tunable resonator comprising:

a planar type dielectric resonator configured of an end short-circuited strip line electrode of substantially a quarter-wavelength;

a coupled capacitor substrate having a first surface and a second surface and being fixed on said planar type dielectric resonator such that said first surface is proximate to said planar type dielectric resonator;

a capacitor electrode disposed on said second surface of said coupled capacitor substrate, said capacitor electrode defining a capacitor between itself and said end short-circuited strip line electrode of said planar type dielectric resonator; and a varactor having a first terminal and a second terminal, said first terminal being connected to said capacitor electrode so as to couple said planar type dielectric resonator with said varactor.

21. A frequency tunable resonator including a varactor in accordance with claim 20 further comprising:

a connection electrode disposed on said second surface of said coupled capacitor substrate and connected to said second terminal of said varactor and to ground.

22. A frequency tunable resonator including a varactor in accordance with claim 20 further comprising:

a second capacitor electrode disposed on said second surface of said coupled capacitor electrode such that a second capacitor is defined between said second capacitor electrode and said open end portion of said resonator electrode of said planar type dielectric resonator; and a side terminal electrode disposed on a side of said coupled capacitor substrate so as to be used as an external connection terminal, said second capacitor electrode being connected to said side terminal electrode.

23. A frequency tunable resonator including a varactor in accordance with claim 20 further comprising:

a second capacitor electrode which disposed on said second surface of said coupled capacitor substrate such that a second capacitor is defined between said second capacitor electrode and said open end portion of said resonator electrode of said planar type dielectric resonator; and a first side terminal electrode disposed on a side of said coupled capacitor substrate so as to be used as an external connection terminal, said second capacitor electrode being connected to said side terminal electrode;

a third capacitor electrode disposed on said second surface of said coupled capacitor substrate such that a third capacitor is defined between said third capacitor electrode and said open end portion of said resonator electrode of said planar type dielectric resonator, said third capacitor electrode being connected to said second terminal of said varactor; and a second side grounded electrode disposed on a side of said coupled capacitor substrate and connecting said third capacitor electrode to ground.

24. A frequency tunable resonator including a varactor comprising:

a coaxial type dielectric resonator configured of an end short-circuited transmission line of substantially a quarter-wavelength, a housing, an end portion, an inner conductor, and an outer conductor;

an inner conductor connection electrode disposed at an end portion of said coaxial type dielectric resonator and connected to said inner conductor;

a coupled capacitor substrate having a first surface and a second surface and being connected to said end portion of said coaxial type dielectric resonator;

a first electrode provided on said first surface of said coupled capacitor substrate and connected to said inner conductor connection electrode;

a second electrode disposed on a second surface of said coupled capacitor substrate opposing said first electrode so as to define a plane capacitor with said first electrode; and a varactor having a first terminal and a second terminal, said first terminal being connected to said second electrode so as to couple said coaxial dielectric resonator with said varactor via said plane capacitor.

25. A frequency tunable resonator including a varactor in accordance with claim 24 further comprising:

an outer conductor connection electrode connected to said outer conductor of said coaxial type dielectric resonator;

a grounded electrode disposed on said second surface of said coupled capacitor substrate and connected to said second terminal of said varactor; and a side electrode disposed on a side surface of said coupled capacitor substrate, said grounded electrode being connected to said side electrode.

26. A frequency tunable resonator including a varactor in accordance with claim 24 further comprising:

an outer conductor connection electrode connected to said outer conductor of said coaxial type dielectric resonator;

a grounded electrode disposed on said second surface of said coupled capacitor substrate, and wherein said coupled capacitor substrate includes a plated hole defined therein, said grounded electrode being connected to said outer conductor connection electrode via said plated hole, and said second terminal of said varactor being connected to said grounded electrode.

27. A frequency tunable resonator including a varactor in accordance with claim 24 further comprising:

a first electrode disposed in a residual area on said second surface of said coupled capacitor substrate opposing said first electrode, said third electrode being used as an external connection terminal.

28. A frequency tunable resonator including a varactor in accordance with claim 24 further comprising:

a third electrode disposed in a part of a residual area on said second surface of said coupled capacitor substrate opposing said first electrode, said third electrode being used as an external connection terminal; and a fourth electrode disposed on said second surface of said coupled capacitor substrate opposing said first electrode, said fourth electrode being connected to said second terminal of said varactor so as to be grounded.

* * * * *